US005178062A

United States Patent [19]

Spiers

[11] Patent Number: 5,178,062

[45] Date of Patent: Jan. 12, 1993

[54] APPARATUS FOR COMPRESSING WASTE MATERIALS

[75] Inventor: Kent Spiers, Caledonia, Miss.

[73] Assignee: Marathon Equipment Company, Vernon, Ala.

[21] Appl. No.: 630,998

[22] Filed: Dec. 19, 1990

[51] Int. Cl.[5] ..... B30B 1/34

[52] U.S. Cl. ..... 100/269 R; 100/229 A; 100/240; 248/645; 414/517

[58] Field of Search ..... 100/103, 179, 190, 214, 100/215, 229 A, 246, 269 R, 299, 240; 414/517, 525.1; 248/637, 645

[56] References Cited

U.S. PATENT DOCUMENTS

| | | | |
|---|---|---|---|
| 2,463,003 | 3/1949 | Stacy | 100/269 R X |
| 3,229,622 | 1/1966 | French et al. | 100/229 A X |
| 3,231,107 | 1/1966 | Clar | 100/229 A X |
| 3,318,231 | 5/1967 | Felts | 100/229 A X |
| 3,368,478 | 2/1968 | Clar | 100/229 A X |
| 3,451,571 | 6/1969 | Brisson | 100/229 A X |
| 3,507,410 | 4/1970 | Liberman et al. | 100/229 A X |
| 3,575,103 | 4/1971 | Charles | 100/269 R X |
| 3,606,830 | 9/1971 | Chaney | 100/229 A X |
| 3,625,140 | 12/1971 | Glanz | 100/229 A X |
| 3,808,967 | 5/1974 | Fair et al. | 100/229 A X |
| 3,815,323 | 6/1974 | Longo | 100/229 A X |
| 3,861,298 | 1/1975 | Melos | 100/229 A X |
| 3,948,163 | 4/1976 | Ligh | 100/269 R X |
| 4,184,424 | 1/1990 | Yeager et al. | 100/229 A X |
| 4,603,625 | 8/1986 | Brown | 100/229 A X |
| 4,715,767 | 12/1987 | Edelhoff et al. | 414/517 X |

FOREIGN PATENT DOCUMENTS

| | | | |
|---|---|---|---|
| 0316025 | 5/1989 | European Pat. Off. | 100/229 A |
| 2410086 | 9/1975 | Fed. Rep. of Germany | 100/229 A |
| 106406 | 4/1967 | United Kingdom | 100/269 R |
| 2194914 | 3/1988 | United Kingdom | 100/240 |

OTHER PUBLICATIONS

E-Z Pack Fixed Packer, One Cubic Yard-Series E--Model 1FPLC, E-Z Pack Company, Galion, Ohio, 44833, 1968.

*Primary Examiner*—Harvey C. Hornsby
*Assistant Examiner*—Stephen F. Gerrity
*Attorney, Agent, or Firm*—Shlesinger, Arkwright & Garvey

[57] ABSTRACT

A preferred embodiment of the present invention is directed to a compactor for compacting waste materials. The compactor includes a compression unit for receiving and compressing waste materials and a power unit detachably connected thereto. The compression unit includes a ram and a pair of piston and cylinder assemblies. The power control unit activates the piston and cylinder assemblies to move the ram between an operating position and a storage position. A support bracket slideably connects the power control unit to the compression unit permitting an individual to readily access the power control unit to service the same. The support bracket extends from the left side wall to the right side wall of the compression unit thereby permitting an individual to attach the power control unit to either the left side or right side of the compression unit.

17 Claims, 3 Drawing Sheets

APPARATUS FOR COMPRESSING WASTE MATERIALS

FIELD OF THE INVENTION

The present invention is directed to a device for compressing waste materials. A preferred embodiment of the present invention is directed to an industrial trash compactor for compacting industrial waste.

BACKGROUND OF THE INVENTION

Compactors have been Widely used in residential and industrial facilities to compress or compact waste materials generated by the occupants thereof. The economical and environmental advantages of compacting waste are well known.

Numerous arrangements for trash compactors have been previously proposed. The following U.S. patents illustrate several known compactors. U.S. Pat. Nos.: 3,229,622; 3,231,107; 3,318,231; 3,625,140; 3,808,967; 4,184,424; 4,603,625; and 4,715,767. However, earlier proposed trash compactors have a number of disadvantages inherent thereto, some of which are enumerated below. For example, some known compactors generally include a compactor housing having a ram and a hydraulic control system permanently stored therein. Such a compacting system is undesirable because the hydraulic control system cannot be readily accessed to service the same.

Other known compactors include a hydraulic control system which is disposed remote from the compactor housing. This arrangement is disadvantageous in that the hydraulic control system is left exposed and, therefore, susceptible to damage. Furthermore, such a system generally takes up a greater amount of space.

Compactors having a hydraulic control system which is removably secured to a compactor housing have been proposed. However, the compactor housing is equipped to receive the control unit at only one predetermined area thereon. Compactors of this type hinder an individual in the placement thereof with respect to surrounding structures. More specifically, the compactor must be located such that the predetermined area is unobstructed.

OBJECTS AND SUMMARY OF THE INVENTION

An object of the present invention is to provide a compactor for compacting waste materials which overcomes one or more of the disadvantages associated with previously known devices.

Another object of the present invention is to provide an apparatus for compressing waste materials which includes a compression unit means for receiving and compressing waste materials. The compression unit means includes an opening for receiving waste materials therein and a housing having at least first and second areas. The first area is removed from the second area. A power unit means is provided for activating and deactivating the compression unit means. Detachable connecting means detachably connects the power unit means to the compression unit means. The detachable connecting means includes receiving means for permitting the compression unit means to alternatively receive at least a portion of the power unit means at the first area and the second area of the compression unit means. One of the advantages of a compactor formed in the manner recited above is that an individual is provided with greater flexibility in positioning the unit with respect to surrounding structures.

A further object of the present invention is to provide an apparatus for compressing waste materials having a compression unit means for receiving and compressing waste materials. The compression unit means includes an opening for receiving waste materials therein. A ram is operably associated with the compression unit means. The ram includes front and rear faces. A power unit means is provided for activating and deactivating the compression unit means for moving the ram between a storage position and an operating position. Detachable connecting means detachably connects the power unit means to the compression unit means. The detachable connecting means includes a support means for supporting the power unit means intermediate the front and rear faces of the ram and at least a portion of the power unit means directly below at least a portion of the ram when in the storage position. An apparatus formed in the manner set forth above is desirable, for among other reasons, because the power unit means can be readily accessed for servicing. Furthermore, by positioning the power unit means with respect to the ram as described the overall size of the unit may be reduced.

Still a further object of the present invention is to provide an apparatus for compressing waste materials having a compression unit means for receiving and compressing waste materials which includes an opening for receiving waste materials therein. The compression unit means further includes front, rear, left side and right side walls. A power unit means is provided for activating and deactivating the compression unit means. Detachable connecting means detachably connects the power unit means to the compression unit means. The detachable connecting means includes support means for supporting the power unit means intermediate the front wall and the rear wall of the compression unit means and at least a portion of the power unit means being disposed directly below at least a portion of the compression unit means. The above apparatus is beneficial in that the detachable connecting means enables an individual to readily service the power unit means. Further, by positioning the power unit means in the manner described above, the overall size of the compactor may be reduced.

Yet still another object of the present invention is to provide an apparatus for compressing waste materials having a compression unit means for receiving and compressing waste materials which includes a housing having front, left, right and rear walls. The housing has an opening for receiving waste materials therein. A power unit means is provided for activating and deactivating the compression unit means. Detachable connecting means detachably connects the power unit means to the compression unit means. The detachable connecting means includes at least one rail support means for receiving and supporting at least a portion of the power unit means upon movement of the power unit means relative to the compression unit means in a direction which forms an angle with at least one of the left and right side walls. By providing the detachable connecting means as set forth above, the power unit means may be readily and easily attached to or detached from the compression unit means.

These objects and advantages as well as others will be readily apparent from a review of the detailed description of the invention, the accompanying drawings and the attached claims.

In summary, a preferred embodiment of the present invention is directed to a compactor for compacting waste materials. The compactor includes a compression unit for receiving and compressing waste materials and a power unit detachably connected thereto. The compression unit included a ram and a pair of piston and cylinder assemblies. The power control unit activates the piston and cylinder assemblies to move the ram between an operating position and a storage position. A support bracket slideably connects the power control unit to the compression unit permitting an individual to readily access the power control unit to service the same. The support bracket extends from the left side wall to the right side wall of the compression unit thereby permitting an individual to attach the power control unit to either the left side or right side of the compression unit.

DETAILED DESCRIPTION OF THE DRAWINGS

DETAILED DESCRIPTION OF THE INVENTION

A preferred embodiment of the present invention will be described hereinafter with reference made to the accompanying drawings.

FIGS. 1 AND 4 THROUGH 8

Figure 1:
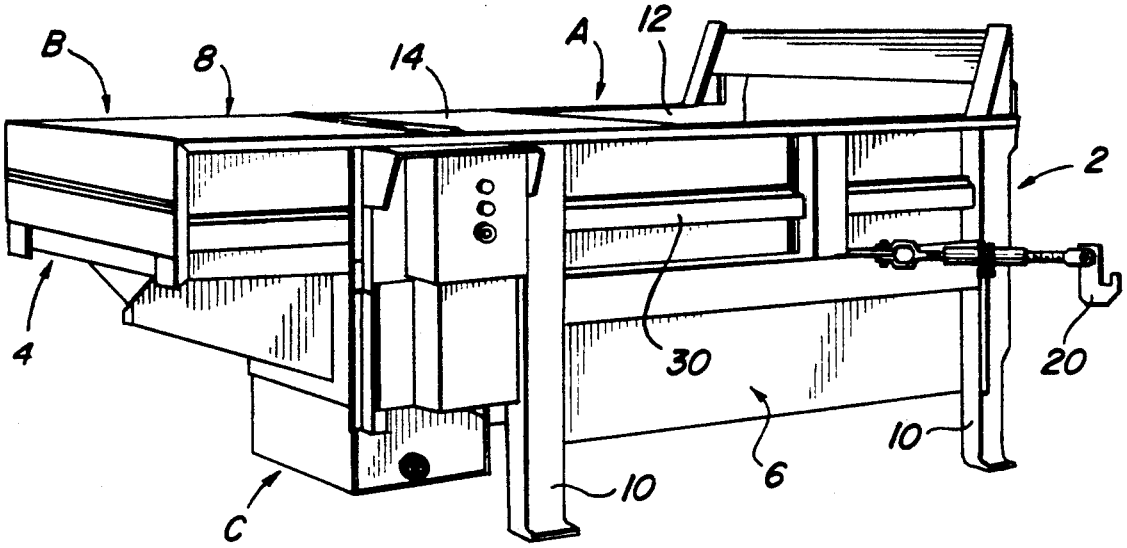
FIG. 1 is a perspective view of the preferred embodiment of the present invention.
Figure 8:
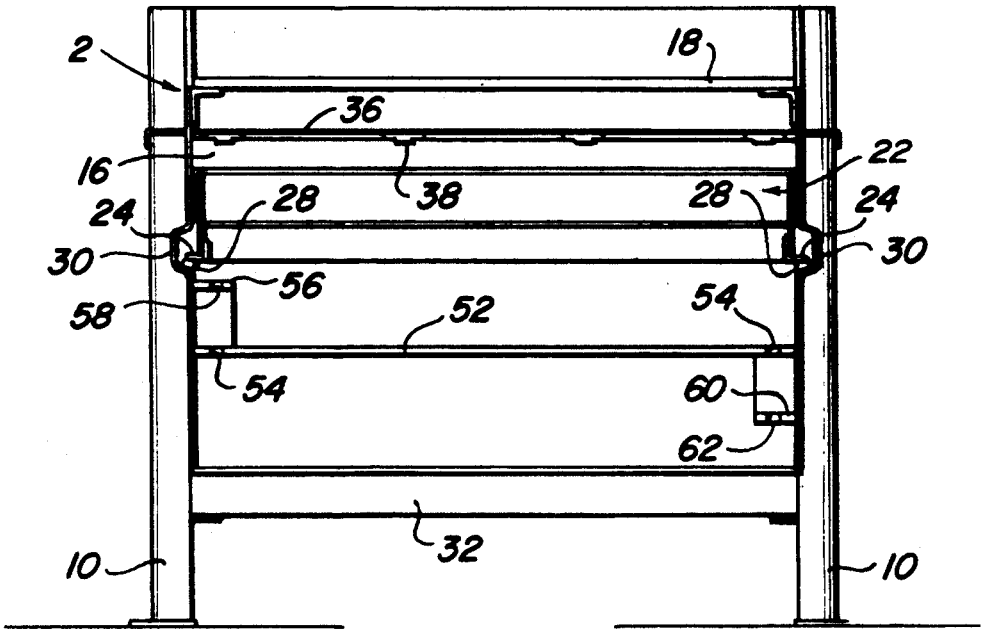
FIG. 8 is a front elevational view of the preferred embodiment of the present invention with portions thereof omitted.

Referring to FIG. 1, a trash compactor assembly A includes a compacting unit B and a power control unit C detachably connected thereto. The compacting unit B includes front wall 2, rear wall 4, left side wall 6 and right side wall 8. A pair of legs 10 extend vertically along the left side wall 6 and right side wall 8 to support the trash compactor assembly on a ground surface. An opening 12 is formed in the upper surface 14 of compacting unit B to permit waste materials to be deposited therein. A substantially rectangularly shaped aperture 16 is formed in front wall 2 of compacting unit B, as best seen in FIG. 8.

Figure 4:
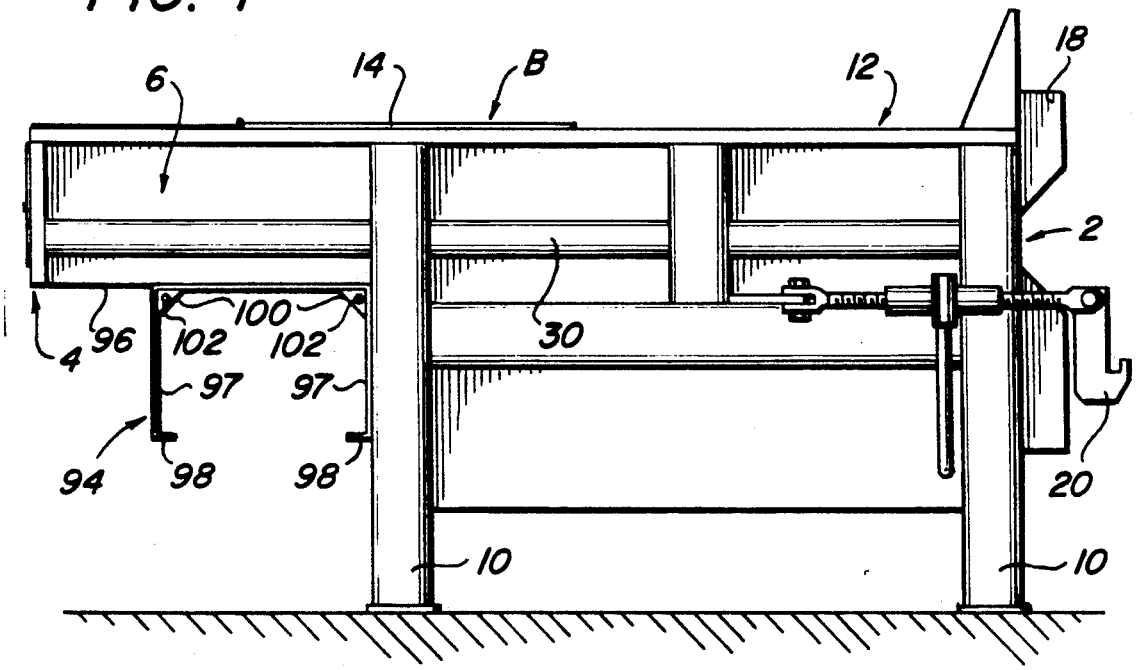
FIG. 4 is a left side elevational view of the embodiment illustrated in FIG. 1 with the hydraulic control unit removed therefrom.

Referring to FIG. 4, a flange 18 extends along the upper, left and right sides of aperture 16. The flange 18 is provided to align a roll-on/roll-off compaction container (not shown) with the compacting unit B. An adjustable clamp 20 extends from each of the left side wall 6 and the right side wall 8 to secure the roll-on/roll-off compaction container to the compacting unit B. The aperture 16 permits waste materials deposited in the compacting unit B to be directed into the roll-on/roll-off compaction container.

Figure 7:
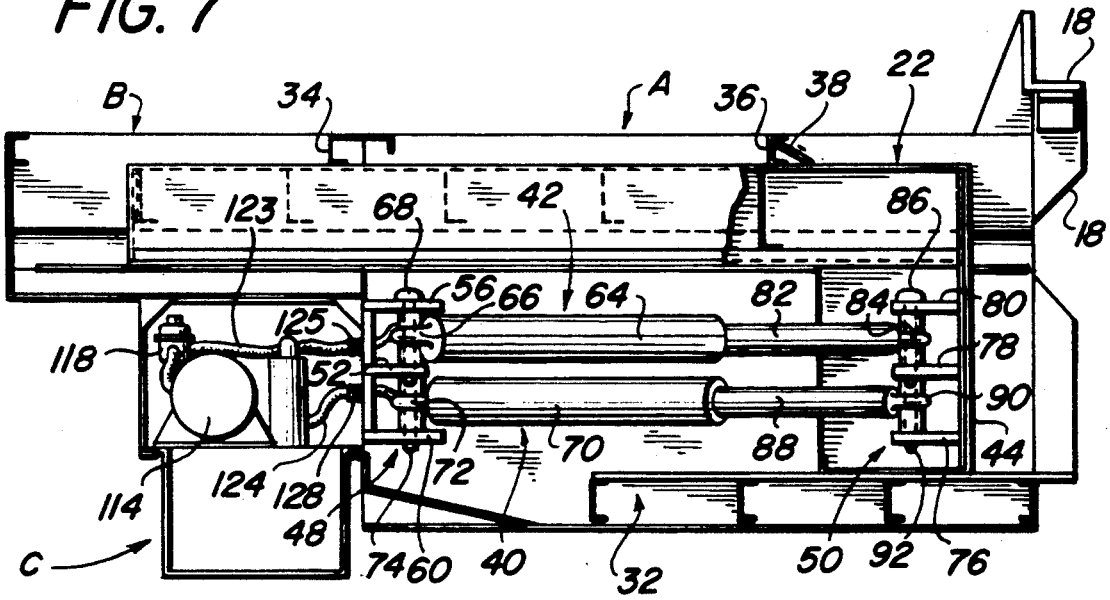
FIG. 7 is a cross-sectional view taken along the longitudinal axis of the embodiment illustrated in FIG. 1 with portions thereof broken away.

Referring to FIG. 7, a ram 22 is positioned in compacting unit B intermediate left side wall 6 and right side wall 8. The ram 22 has a substantially L-shaped configuration. A pair of runners 24 extend outwardly from the side walls 26 of ram 22, as best shown in FIG. 8. The runners 24 are slideably supported by wear strips 28 removably secured to substantially U-shaped grooves 30 formed in the left and right side walls 6 and 8. Platform 32 supports the lower end of ram 22. Guide members 34 and 36 extend downwardly from the upper surface 14 and between left side wall 6 and right side wall 8. The guide members 34 and 36 prevent the ram from being displaced in the vertical direction. A wiper 38 is pivotally connected to the guide member 36.

Piston and cylinder assemblies 40 and 42 extend between the operating face 44 of ram 22 and wall 46 of compacting unit B. Bracket assemblies 48 and 50 pivotally support piston and cylinder assemblies 40 and 42 between operating face 44 and wall 46.

Referring to FIG. 8, bracket assembly 48 includes an intermediate plate 52 which extends from the left side wall 6 to the right side wall 8. Openings 54 are formed in intermediate plate 52 adjacent side walls 6 and 8. An upper plate 56 extends inwardly from side wall 6 and includes an opening 58 extending therethrough which is aligned with the corresponding opening 54 of intermediate plate 52. A lower plate 60 extends inwardly from side wall 8 and includes an opening 62 extending therethrough which is aligned with the corresponding opening 54 in intermediate plate 52. Cylinder 64 of assembly 42 has an eyelet 66 extending from the rearmost portion thereof. A pin 68 extends through eyelet 66 and openings 54 and 58 to pivotally connect the piston and cylinder assembly 42 to bracket assembly 48. Similarly, cylinder 70 of piston and cylinder assembly 40 includes an eyelet 72 at its rearmost portion. A pin 74 extends through eyelet 72 and openings 54 and 62 to pivotally connect piston and cylinder assembly 42 to bracket assembly 48.

Bracket assembly 50 includes lower plate 76, intermediate plate 78 and upper plate 80, as best seen in FIG. 7. Plates 76, 78 and 80 extend from the left side wall 6 to the right side wall 8. Openings are formed in the left and right ends of each of the plates 76, 78 and 80. The opening in the left ends of plates 76, 78 and 80 are aligned in the vertical direction. Similarly, the openings in the right ends of plate 76, 78 and 80 are aligned in the vertical direction. Piston 82 of piston and cylinder assembly 42 has an eyelet 84 extending from the forwardmost end thereof. A pin 86 extends through the openings in the right ends of plates 78 and 80 to pivotally connect the piston and cylinder assembly 42 to bracket assembly 50. Thus, the piston and cylinder assembly 42 extends forwardly from the left side wall 6 at a position adjacent wall 46 to the right side wall 8.

Piston 88 of piston and cylinder assembly 40 includes an eyelet 90 extending from the forwardmost end thereof. A pin 92 extends through the eyelet 90 and the openings formed in the left ends of plates 76 and 78 to pivotally connect piston and cylinder assembly 40 to bracket assembly 50. Piston and cylinder assembly 40 extends forwardly from right side wall 8 at a position adjacent wall 46 to left side wall 6. Thus, the piston and cylinder assemblies 40 and 42 intersect each other forming a substantially X-shaped arrangement.

Figure 5:
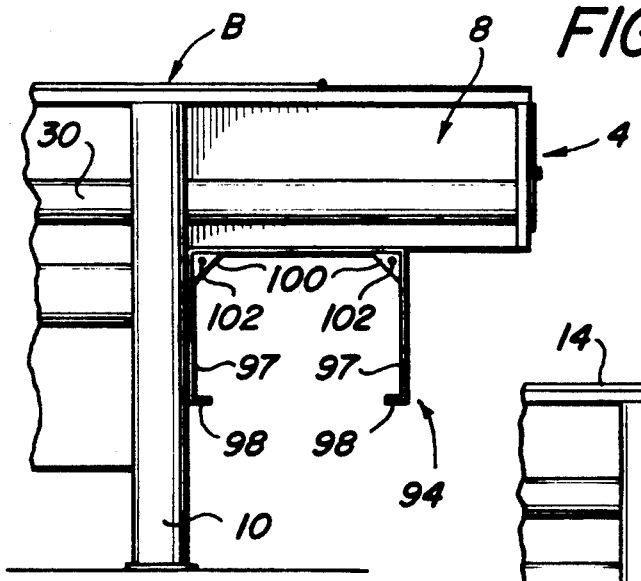
FIG. 5 is a fragmentary right side elevational view of the embodiment illustrated in FIG. 1 with the hydraulic control unit removed therefrom.
Figure 6:
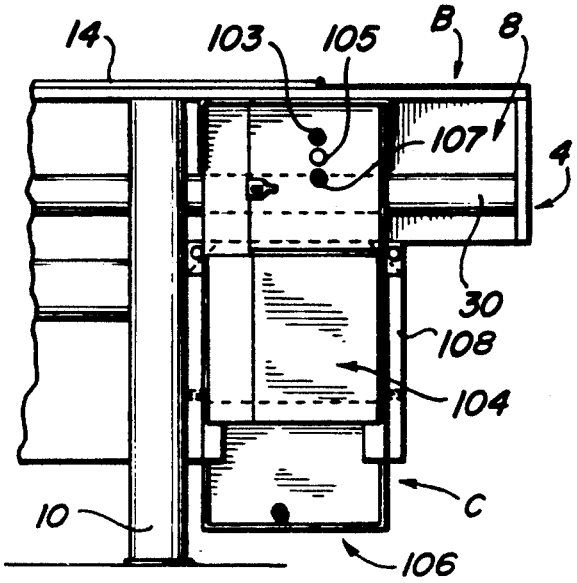
FIG. 6 is a fragmentary right side elevational view of the embodiment illustrated in FIG. 1.

Referring to FIGS. 4 and 5, a substantially U-shaped bracket 94 is secured to wall 96 of compression unit B. The bracket 94 extends from the left side wall 6 to the right side wall 8 of compression unit B. Retaining bracket 94 includes a pair of arms 97 which are spaced from each other. An inwardly extending lip 98 is formed on the lowermost ends of each of the arms 97. Angle plates 100 are disposed adjacent the uppermost portions of arms 96 at the left and right ends thereof, as best seen in FIGS. 4 and 5. An opening 102 is formed in each of the plates 100.

FIGS. 2, 3 AND 7

Figure 2:
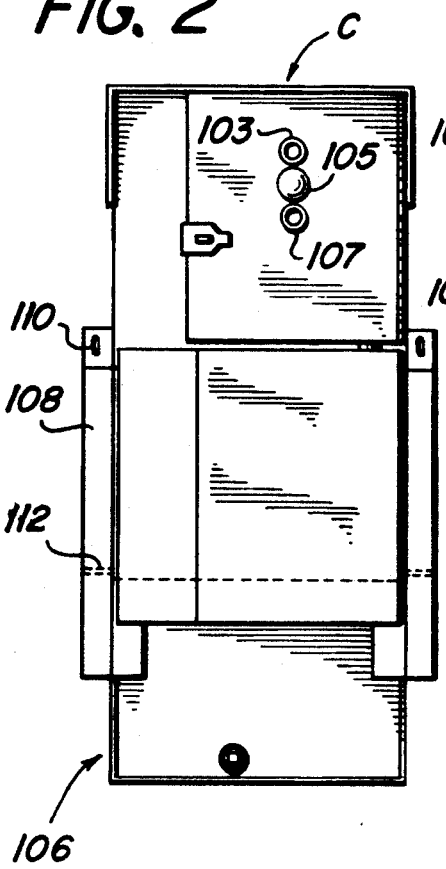
FIG. 2 is a front elevational view of the hydraulic control unit formed in accordance with the present invention.
Figure 3:
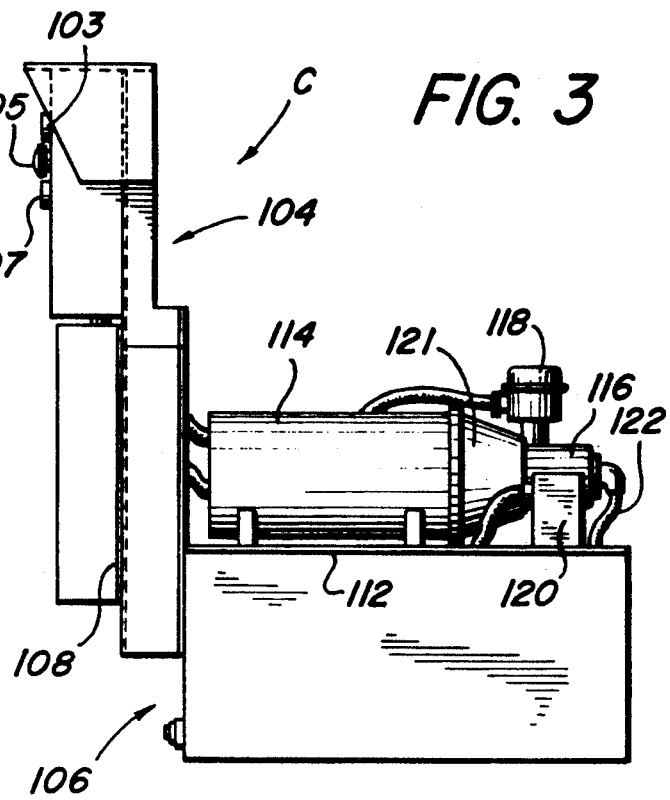
FIG. 3 is a side elevational view of the hydraulic control unit illustrated in FIG. 2.

Referring to FIGS. 2 and 3, power control unit C includes a vertically extending control panel 104 and a horizontally extending reservoir housing 106. Plates 108 extend outwardly from the control panel 104. Openings 110 are formed in the uppermost portions of plates 108. The control panel includes a key start 103, an emergency stop 105 and a reverse switch 107 for controlling movement of ram 22.

Supporting plates or lips 112 extend outwardly from the reservoir housing 106. Electric motor 114, hydraulic pump 116, directional valve 118 and pressure relief valve 120 are mounted on the upper surface of reservoir housing 106. A pump motor adapter 121 detachably connects the hydraulic pump 116 to the electric motor 114. A reservoir (not shown) is housed in reservoir housing 106. The pressure relief valve is of conventional construction and the operation thereof is well known and, therefore, will not be described hereinafter. A tube 122 extends from the suction side of pump 116 to the reservoir in reservoir housing 106. The directional valve 118 is of conventional design and communicates with hydraulic pump 116. Fluid hoses 123 and 124 communicate at one end with directional valve 118 and the other end with piston and cylinder assemblies 40 and 42. More specifically, hose 123 is connected to a T-shaped fluid connector 125 at the base thereof. A pair of hoses extend from the upper ports of the T-shaped connector 125 to the lowermost portions of cylinders 64 and 70. Similarly, hose 124 is connected to a T-shaped connector 128 at the base thereof. A hose extends from each of the ports in the upper portion of the T-shaped connector 128 and communicate with the forwardmost portions of cylinders 64 and 70. As is well known, directional valve 118 moves between two positions, the first of which allows fluid to pass through hose 123 to expand the piston and cylinder assemblies 40 and 42 which in turn moves ram 22 in the direction of front wall 2 to compress waste materials. In the second position, the directional valve 118 supplies fluid through hose 124 to the uppermost portions of cylinders 64 and 70 to retract the piston and cylinders assemblies 40 and 42. In this position, the fluid in the lowermost portions of cylinder 64 and 70 is drained through hose 123 to the reservoir in reservoir housing 106.

In the storage position, i.e. when the assemblies 40 and 42 are fully retracted, the operating face 44 of ram 22 is aligned with the front edge of wiper 38. Preferably, in the storage position, the operating face 44 is approximately 42 inches from the front wall 2. Thus, in the storage position, the operating face 44, side walls 6 and 8 and platform 32 define a chamber in which waste materials may be deposited in through opening 12. In the preferred embodiment, the operating face 44 extends approximately 14 inches forward of the front wall 2, when the piston and cylinder assemblies 40 and 42 are fully extended. Therefore, upon forward movement of ram 22 waste materials deposited in compacting unit B are directed to and compressed in the associated roll-on/roll-off container.

Preferably, the piston and cylinder assemblies 40 and 42 each form angle of approximately 20° with wall 46 in the fully retracted position and an angle of approximately 85° in the fully extended position. The angular placement of the assemblies 40 and 42 in the compacting unit B is advantageous because the overall size of the trash compacting assembly A may be reduced.

FIGS. 2 THROUGH 6

The manner in which the power control unit C is detachably connected to the compacting unit B will now be described. Preferably, the power control unit C is placed on a cart and wheeled to the left side wall 6 of the trash compactor assembly A. The cart should have a height such that lips 112 extending from reservoir housing 106 are positioned directly above lips 98 of bracket 94. Once the lips 98 are aligned with lips 112, the cart is pushed inwardly until the control panel 104 abuts the side wall 6. Bolts may be inserted into openings 110 of plate 108 and through openings 102 in corresponding plates 100 to secure the power control unit C to the compacting unit B. Subsequently, the cart is removed. In the event that side walls 6 is positioned up against a building or is otherwise obstructed, the control unit C may be connected to the compacting unit B from the right side wall 8 in a similar manner. Further, the control unit C may be located remote from the compacting unit B. This aspect of the preferred embodiment provides an individual with greater flexibility in positioning the trash compacting assembly A. Also, the control unit C may be readily detached from the compacter unit B to service the same.

The L-shaped configurations of ram 22 and power control unit C permit the electric motor 114, hydraulic pump 116, directional value 118 and pressure relief valve 120 to be stored directly below the compacting unit B between the front and rear surfaces thereof. This arrangement is desirable for several reasons. First the components supported by control unit C are protected from damage. Further, this arrangement reduces the overall size of the trash compactor assembly A.

While this invention has been described as having a preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. An apparatus for compressing waste materials, comprising:

a) compression unit for receiving and compressing waste materials, said compression unit having an opening for receiving waste materials therein, at least one piston and cylinder assembly and at least one ram operably connected to said piston and cylinder assembly, said ram being movable between an operating position wherein said ram acts to compress waste material and a storage position wherein said piston is fully retracted in said cylinder, said compression unit further including a housing having at least first and second areas, said first area being removed from said second area;

b) a power unit for activating and deactivating said compression unit;

c) detachable connecting means for detachably connecting said power unit to said compression unit; and, d) said detachable connecting means including receiving means for permitting said compression unit to selectively receive at least a portion of said power unit at said first area and said second area of said compression unit when said ram is in the storage position.

2. An apparatus as in claim 1, wherein:

a) said compression unit includes front, rear, left side and right side walls; and, b) said first area is formed in said left side wall and said second area is formed in said right side wall.

3. An apparatus as in claim 1, wherein:

a) said compression unit includes front, rear, left side and right side walls; and, b) said receiving means includes at least one rail support means for receiving and supporting at least a portion of said power unit upon movement of said power unit relative to said compression unit in a direction which forms an angle with at least one of said left side and right side walls.

4. An apparatus as in claim 3, wherein:

a) said at least one rail support means is disposed intermediate said front and rear walls of said compression unit.

5. An apparatus as in claim 1, wherein:

a) said compression unit includes a pair of piston and cylinder assemblies operably connected to said ram, said pair of piston and cylinder assemblies are disposed in a substantially X-shaped arrangement.

6. An apparatus as in claim 1, wherein:

a) said power unit is substantially L-shaped.

7. An apparatus as in claim 1, wherein:

a) said compression unit includes front, rear, left side and right side walls;

b) said receiving means includes first and second guide rails, said first guide rail is spaced from said second guide rail and said first and second guide rails extend from said left side wall to said right side wall; and, c) said power unit includes first and second lip means extending therefrom for engaging corresponding first and second guide rails of said compression unit.

8. An apparatus for compressing waste materials, comprising:

a) compression unit having a housing, said housing including an opening for receiving waste material, said housing having first and second bottom surfaces, said first bottom surface extending substantially parallel to said second bottom surface, said second bottom surface being offset upwardly from said first bottom surface;

b) a ram positioned in said housing of said compression unit, said ram including a front compacting face;

c) a power unit means for activating and deactivating said compression unit for moving said ram between a storage position and an operating position; and, d) detachable connecting means for detachably connecting said power unit means to said compression unit, said detachable connecting means being secured to and extending downwardly from said second bottom surface, said detachable connecting means extending substantially the entire width of said second bottom surface thereby permitting said power unit means to be inserted from either side of said compression unit.

9. An apparatus as in claim 8, wherein:

a) said compression unit includes at least one leg means for supporting said compression unit on a ground surface; and, b) said support means is adapted to support said power unit means above the ground surface.

10. An apparatus as in claim 8, wherein:

a) said power unit includes an electric motor operably connected to a hydraulic pump.

11. An apparatus as in claim 10, wherein:

a) said compression unit includes front, rear, left side and right side walls; and, b) said ram, in said storage position, is disposed intermediate said front wall and said rear wall of said compression unit.

12. An apparatus as in claim 8, wherein:

a) said power unit means includes a vertically extending member and a horizontally extending member, at least a portion of said horizontally extending member is disposed directly below at least a portion of said ram.

13. An apparatus as in claim 8, wherein:

a) said compression unit includes first and second piston and cylinder assemblies, said first and second assemblies extend between said power unit means and said front face of said ram, and said first assembly intersects said second assembly to form a substantially X-shaped configuration.

14. An apparatus for compressing waste materials, comprising:

a) compression unit means for receiving and compressing waste materials, said compression unit means including a housing having front, left side, right side and rear walls, said housing further including an opening for receiving waste materials, said compression unit means including at least one piston and cylinder;

b) power unit means for activating and deactivating said compression unit means, said power unit means having a forwardmost portion; and, c) detachable connecting means for detachably connecting said power unit means to said compression unit means such that said forwardmost portion is positioned rearwardly of said piston and cylinder, said detachable connecting means including at least one rail support means for receiving and supporting at least a portion of said power unit means upon movement of said power unit means relative to said compression unit means in a direction which forms an angle with at least one of said left and right side walls.

15. An apparatus as in claim 14, wherein:

a) said detachable connecting means includes first and second guide rails fixed to and extending downwardly from said compression unit means, said first guide rail is spaced from said second guide rail, said first and second guide rails extend in a direction substantially perpendicular to said left and right side walls;

b) said power unit means includes a vertically extending member which has upper and lower edges and a horizontally extending member connected to said vertically extending member adjacent said lower edge; and, c) first and second lip means extend from said horizontally extending member of said power unit means for engaging corresponding first and second guide rails.

16. An apparatus as in claim 14, wherein:

a) said compression unit means includes at least one leg means for supporting said compression unit means on a ground surface; and, b) said first and second guide rails are adapted to support said power unit means above the ground surface.

17. An apparatus for compressing waste materials, comprising:

a) compression unit for receiving and compressing waste materials, said compression unit including at least one piston and cylinder, said compression unit further including a housing having an opening for receiving waste materials;

b) power unit for activating and deactivating said compression unit, said power unit having a forwardmost portion; and, c) at least one support member for detachably connecting said power unit to said compression unit such that said forwardmost portion is positioned rearwardly of a rearwardmost portion of said cylinder, said at least one support member being secured to said housing.

* * * * *